US008134095B2

(12) United States Patent
Kiyono et al.

(10) Patent No.: US 8,134,095 B2
(45) **Date of Patent: *Mar. 13, 2012**

(54) SWITCH HAVING A MOVABLE CONTACT PIECE WITH A J-SHAPED CROSS SECTION

(75) Inventors: Yasuhiro Kiyono, Nagaokakyo (JP); Toshihiro Naruo, Kyoto (JP)

(73) Assignee: OMRON Corporation, Kyoto (JP)

( * ) Notice: Subject to any disclaimer, the term of this patent is extended or adjusted under 35 U.S.C. 154(b) by 205 days.

This patent is subject to a terminal disclaimer.

(21) Appl. No.: 12/534,638

(22) Filed: Aug. 3, 2009

(65) Prior Publication Data

US 2010/0032273 A1 Feb. 11, 2010

(30) Foreign Application Priority Data

Aug. 5, 2008 (JP) ..... 2008-201626

(51) Int. Cl.
*H01H 13/14* (2006.01)

(52) U.S. Cl. ..... 200/520; 200/417

(58) Field of Classification Search ..... 200/520–524, 200/529, 530, 545–558, 16 A–16 F, 329, 200/417, 449, 442–468
See application file for complete search history.

(56) References Cited

U.S. PATENT DOCUMENTS 7,009,131 B2 * 3/2006 Diep ..... 200/523

FOREIGN PATENT DOCUMENTS

| | | | |
|---|---|---|---|
| EP | 1182673 | A2 | 2/2002 |
| EP | 2012333 | A1 | 1/2009 |
| JP | 10-208581 | A | 8/1998 |

OTHER PUBLICATIONS

Extended European Search Report Issued in European Application No. 09166916.8-2214, Dated Dec. 20, 2011 (4 Pages).

* cited by examiner

*Primary Examiner* — Renee Luebke
*Assistant Examiner* — Marina Fishman
(74) *Attorney, Agent, or Firm* — Osha • Liang LLP

(57) ABSTRACT

A switch has a supporting terminal assembled to a base, a movable contact piece, made of a band-shaped conductive material bent to a substantially J-shaped cross section, having a movable contact at one end and having an intermediate portion rotatably supported by a rotation receiving portion of the supporting terminal, a plunger accommodated so as to be movable up and down in an internal space formed by fitting a housing to the base, and a coil spring including a forced dissociation bent portion at one end and being rotatably supported by the plunger. The plunger is moved up and down to slidably move one end of the coil spring while pressure contacting the other end edge of the movable contact piece to invert the movable contact piece and contact or separate the movable contact to and from a fixed contact, and to lock a distal end of the forced dissociation bent portion to the other end edge of the movable contact piece and exert a shear force on the movable contact of the movable contact piece.

6 Claims, 20 Drawing Sheets

40,41
50,52
60
53
45
31
26
25
30
23
(24)
32
51
21
42
50
10
40
44d,43
44c
44b
44a
35
36
44f
44e
44g 40,41
50,52
60
53
45
31
26
25
30
23
(24)
32
42
50
51
10
21

40,41
60
53
45
31
26
25
30
23
(24)
32
21
50,52
42
50,51
10

40,41
60
45
31
26
25
30
53
23
(24)
32
21
50,52
42
51

40
36
44b
44a
35
44f
44g 40
44b
44a
35
36
44f
44g

SWITCH HAVING A MOVABLE CONTACT PIECE WITH A J-SHAPED CROSS SECTION

BACKGROUND OF THE INVENTION

1. Technical Field

The present invention relates to switches, in particular to a switch for opening and closing a contact with a pushing operation.

2. Related Art

Conventionally, a switch for opening and closing a contact with a pushing operation has the following structure (see Japanese Unexamined Patent Publication No. 10-208581).

The switch structure is such that a movable terminal 37 is reciprocated in an up and down direction by an operation of a button 14, and movable contacts 41, 41 arranged at both ends of the movable terminal 37 are contacted to and separated from fixed contacts 45, 45 facing the movable contacts 41, 41.

SUMMARY

However, in the above-described switch structure, the movable terminal 37 needs to be supported with a holding spring 46 and a returning spring 47, and thus the number of parts and the number of assembly steps are great, and a cost is high.

Furthermore, as the movable terminal 37 follows the operation of the button 14, a displacement speed of the movable terminal 37, that is, an opening/closing speed of the contact is substantially equal to the operation speed of the button 14, and thus the contact cannot be instantaneously opened and closed. As a result, a contact having a large contacting area is necessary to prevent contact wear in opening and closing a contact of large current, and the switch cannot be miniaturized.

One or more embodiments of the present invention provides a small switch capable of instantaneously opening and closing a contact with fewer number of parts and fewer number of assembly steps.

A switch according to one or more embodiments of the present invention includes: a supporting terminal assembled to a base; a movable contact piece, made of a band-shaped conductive material bent to a substantially J-shaped cross section, having a movable contact at one end and having an intermediate portion rotatably supported by a rotation receiving portion of the supporting terminal; a plunger accommodated so as to be movable up and down in an internal space formed by fitting a housing to the base; and a coil spring including a forced dissociation bent portion at one end and being rotatably supported by the plunger; wherein the plunger is moved up and down to slidably move one end of the coil spring while pressure contacting the other end edge of the movable contact piece to invert the movable contact piece and contact or separate the movable contact to and from a fixed contact, and to lock a distal end of the forced dissociation bent portion to the other end edge of the movable contact piece and exert a shear force on the movable contact of the movable contact piece.

According to one or more embodiments of the present invention, since the contact can be opened and closed by reciprocating the plunger with one coil spring, the number of parts and the number of assembly steps can be reduced, and the cost can be reduced.

Moreover, a contact having a large contacting area is not necessary to prevent contact wear since the movable contact piece instantaneously inverts with the spring force of the coil spring and the opening/closing speed of the contact significantly increases, and thus the switch can be miniaturized.

Furthermore, contact welding can be resolved since the forced dissociation bent portion of the coil spring locks with the other end of the movable contact piece, and exerts a shear force on the movable contact.

In one or more embodiments of the present invention, a middle of the other end edge of the movable contact piece may be cut and bent to an inner side to form a forced dissociation tongue piece that locks with the forced dissociation bent portion of the coil spring.

According to the present embodiment, the forced dissociation bent portion of the coil spring is reliably locked with the forced dissociation tongue piece arranged at the movable contact piece, the shear force and bending moment are exerted on the movable contact piece, and the contact welding can be effectively resolved.

In one or more embodiments of the present invention, a cutout portion may be formed at the other end edge of the movable contact piece, and the one end of the coil spring may be bent to a substantially U-shape to form the forced dissociation bent portion which distal end locks with an inner side surface edge of the cutout portion.

According to the present embodiment, the welding contact can be resolved since a large shear force can be exerted on the movable contact piece at an early stage and the bending moment can be exerted on the movable contact piece by locking the distal end of the bent portion to the inner side surface of the movable contact piece.

The forced dissociation tongue piece does not need to be cut and bent at one end of the movable contact piece, the number of production steps of the movable contact piece can be reduced, and productivity can be enhanced.

In one or more embodiments of the present invention, the forced dissociation bent portion of the coil spring may be locked with a forced dissociation tongue piece formed by bending the entire other end edge of the movable contact piece to an inner side surface side.

According to the present embodiment, the welding contact can be resolved since the forced dissociation bent portion of the coil spring is locked with the distal end edge of the forced dissociation tongue piece of the movable contact piece, a large shear force can be exerted on the movable contact piece at an early stage and the bending moment can be exerted on the movable contact piece.

Since the forced dissociation bent portion of the coil spring locks with the forced dissociation tongue piece of wide width of the movable contact piece, it is less likely to drop out and high reliability can be obtained.

In one or more embodiments of the present invention, the entire other end edge of the movable contact piece may be bent to an outer side surface side to form a forced dissociation tongue piece, a cutout portion may be formed at a central part thereof, the one end of the coil spring may be engaged to the cutout portion, and the forced dissociation bent portion may be locked with the forced dissociation tongue piece.

According to the present embodiment, one end of the coil spring engages the cutout portion of the movable contact piece, and the distal end of the forced dissociation bent portion locks with the forced dissociation tongue piece. Thus, in addition to the coil spring being less likely to drop out from the movable contact piece, a large shear force is exerted on the movable contact piece at an early stage, and the bending moment for raising the movable contact piece acts thereon. As a result, the contact welding can be effectively resolved.

In one or more embodiments of the present invention, a middle of the other end edge of the movable contact piece may be cut and bent to an inner side to form a forced dissociation tongue piece, the one end of the coil spring may be bent to a substantially C-shape to form the forced dissociation bent portion, and the forced dissociation bent portion may be locked with the forced dissociation tongue piece.

According to the present embodiment, the forced dissociation bent portion is less likely to drop out from the forced dissociation tongue piece as the forced dissociation bent portion of the coil spring locks with the distal end edge of the forced dissociation tongue piece of the movable contact piece. In particular, the spring force of the coil spring acts on the distal end edge of the bent portion as a large shear force at an early stage, and the bending moment acts on the movable contact piece, and thus the contact welding can be reliably resolved.

BRIEF DESCRIPTION OF THE DRAWINGS

FIGS. 6A to 6C, and FIGS. 7C and 7D are partially enlarged views showing the operation of the cam mechanism following FIGS. 6D and 6E;

FIGS. 7A and 7B, and FIGS. 8C and 8D are partially enlarged views showing the operation of the cam mechanism following FIG. 7C and 7D;

FIGS. 9A, 9B, and 9C are cross-sectional views showing the operation process following FIGS. 8A and 8B, and FIGS. 9D and 9E are partially enlarged views showing the operation of the cam mechanism following FIGS. 8C and 8D;

DETAILED DESCRIPTION

Figure 1B:
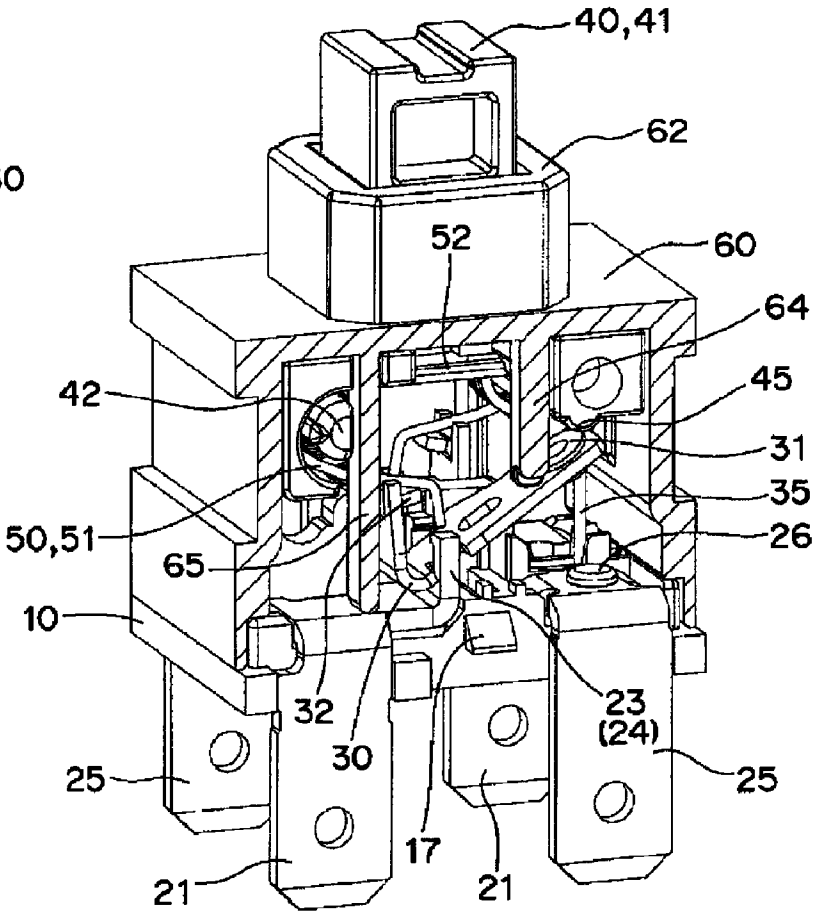
FIGS. 1A and 1B are a perspective view and a partial cross-sectional perspective view showing a switch according to a first embodiment of the present invention.
Figure 1A:
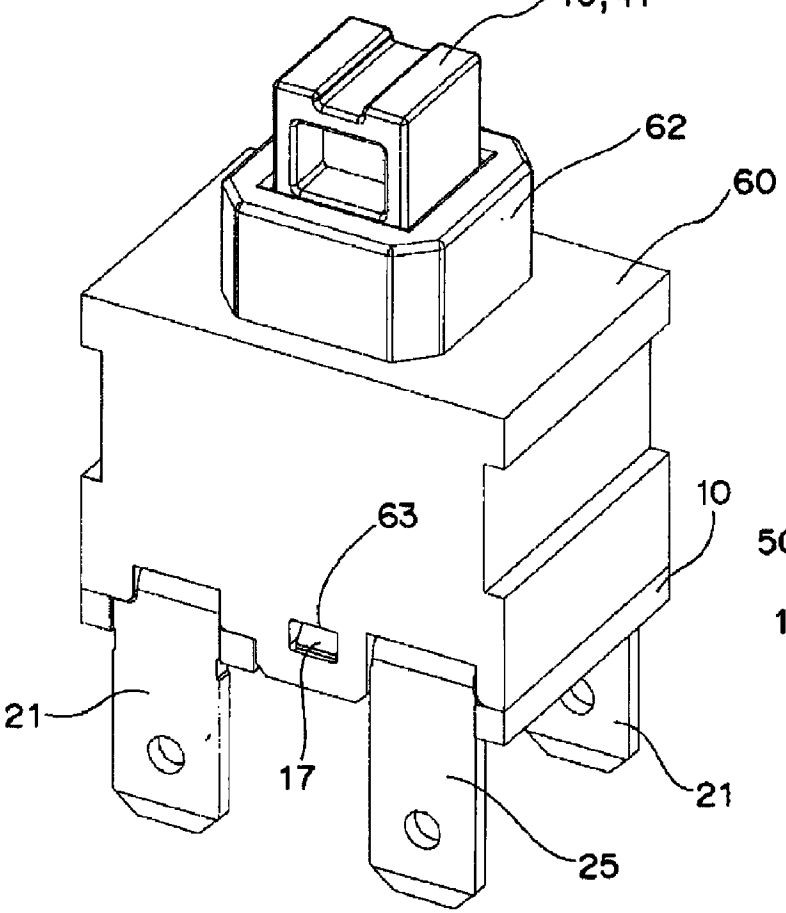

Hereinafter, preferred embodiments of the present invention will be described with reference to the accompanied drawings, FIGS. 1A to 20.

As shown in FIGS. 1A to 11B, a switch according to a first embodiment is configured by a base 10, two sets of contact mechanisms 20, 20 assembled to the base 10, a plunger 40, including pair of coil springs 50, 50 and a lock pin 35, for operating the contact mechanisms 20, 20, and a housing 60, fitted to the base 10 to cover the contact mechanisms 20, 20, for supporting the plunger 40 so as to be movable up and down.

Figure 2:
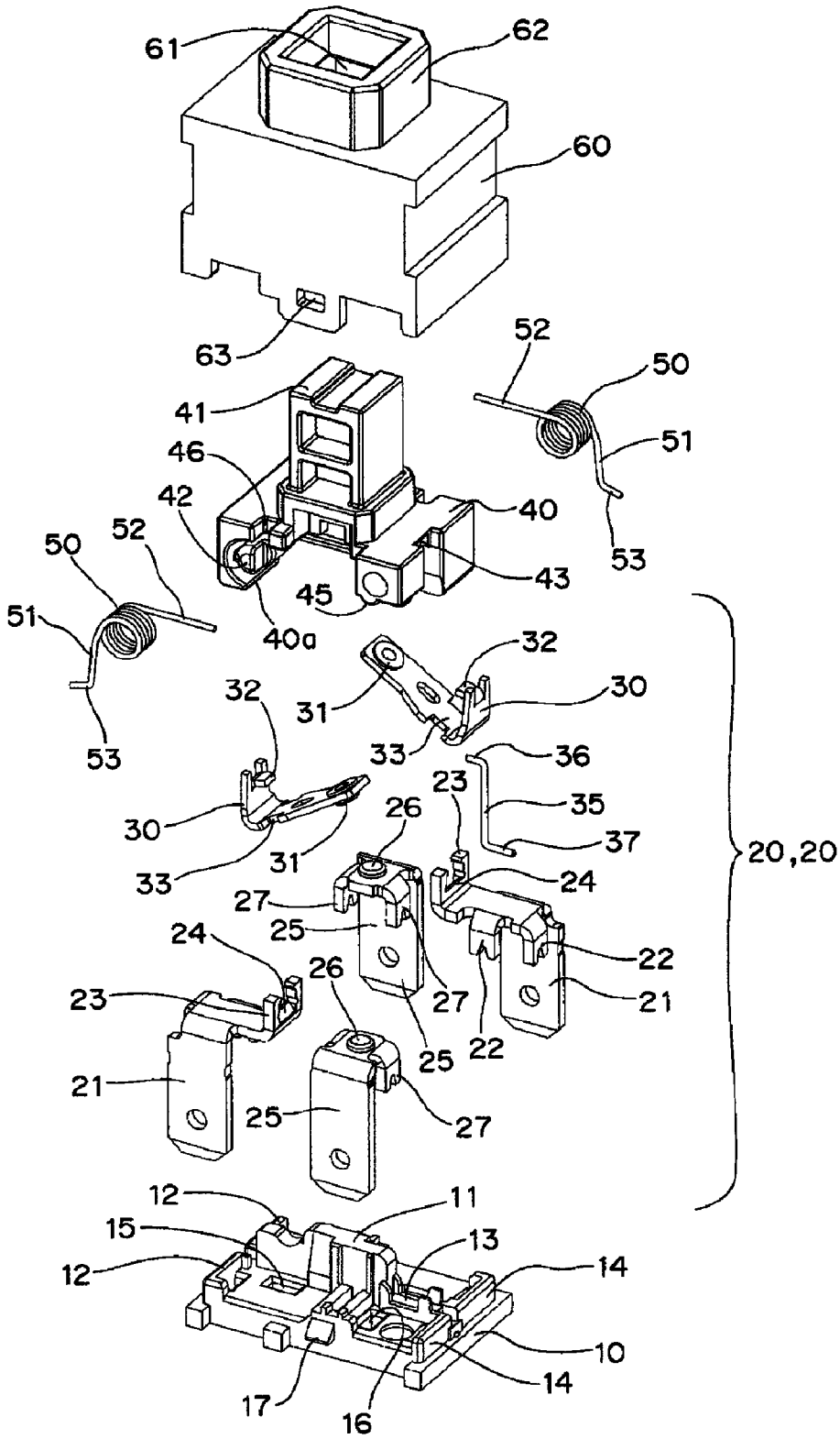
FIG. 2 is an exploded perspective view of the switch shown in FIG. 1.

As shown in FIG. 2, the base 10 has a pair of insulation walls 12, 12 arranged in a projecting manner on the same line from one end side of a partition wall 11 arranged in a projecting manner from the middle of the upper surface of the base 10 and an engagement groove 13 formed on an extended line on the other end side, and also has a pair of insulation walls 14, 14 arranged in a projecting manner on the same line from the other end side of the engagement groove 13. Press-fit corner square holes 15, 16 are formed in the vicinity of the insulation walls 12, 14, respectively. Engagement projections 17, 17 are arranged on the opposing outer side surfaces of the base 10. An insertion hole 18 communicating to the engagement groove 13 is formed at the bottom surface of the base 10 to attach the lock pin 35, to be hereinafter described, afterwards. An engagement projection 18*a* that engages with the lock pin 35 and a slip-out preventing nail portion 18*b* for preventing the lock pin 35 from slipping out are arranged in a projecting manner on the inner side surface of the insertion hole 18.

As shown in FIG. 2, the contact mechanism 20 includes a support terminal 21, a fixed contact terminal 25, and a movable contact piece 30. The support terminal 21 is made of a conductive material bent to an L-shaped cross-section, where press-fit tongues pieces 22, 22 are extended from adjacent edges of one end, and a raised piece 23 is extended from the remaining edge of the one end. The distal end edge of the raised piece 23 is cut to form a rotation receiving portion 24. The support terminal 21 is assembled by press-fitting the press-fit tongue pieces 22, 22 to the press-fit square holes 15, 15 of the base 10.

The fixed contact terminal 25 is made of a conductive portion bent to a substantially L-shaped cross section, where a fixed contact 26 is arranged at one end and press-fit tongue pieces 27, 27 are extended from both side edges of the relevant one end. The fixed contact terminal 25 is assembled by press-fitting the press-fit tongue pieces 27, 27 to the press-fit square holes 16, 16 of the base 10.

Figure 3A:
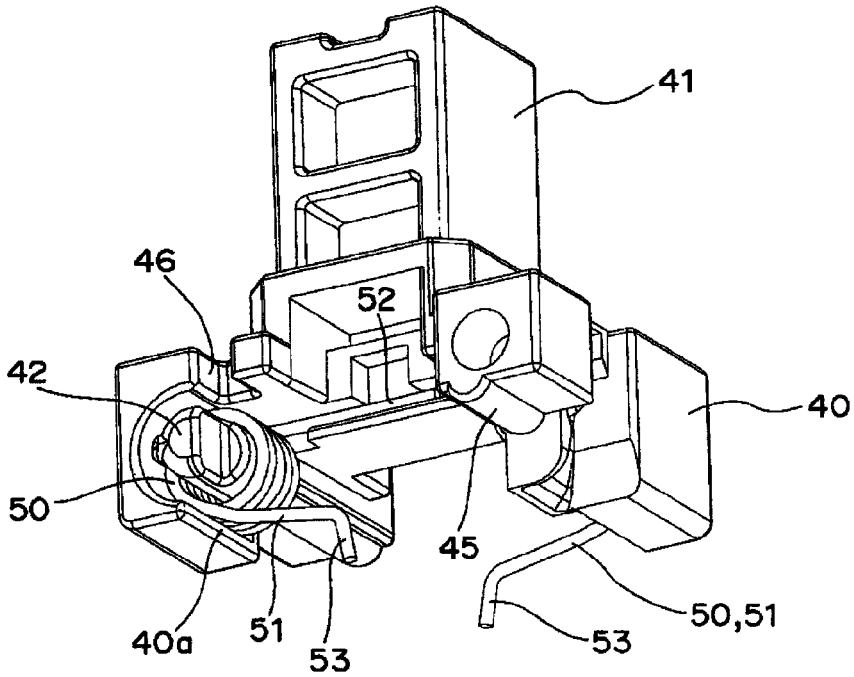
FIGS. 3A and 3B are perspective views of a plunger and a base shown in FIG. 2.
Figure 3B:
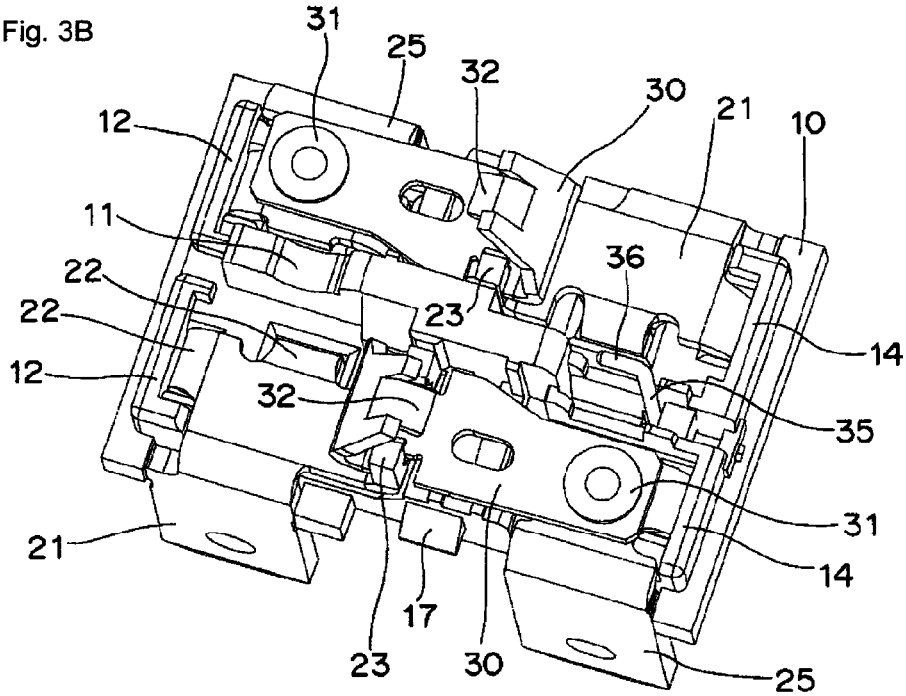
Figure 4:
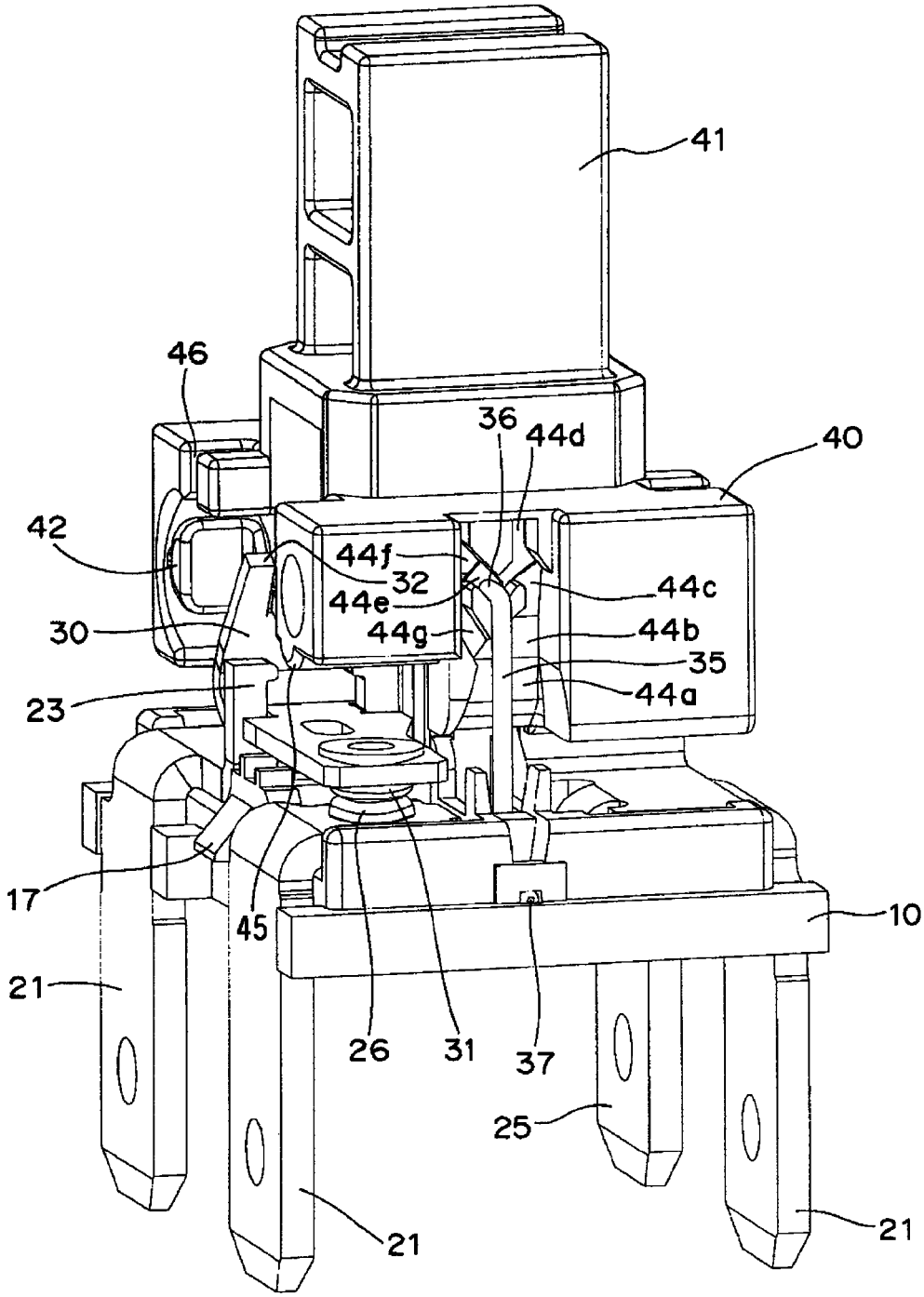
FIG. 4 is a perspective view in which a housing of the switch shown in FIG. 1 is detached.

The movable contact piece 30 is made of a band-shaped conductive material bent to a substantially J-shaped cross-section, where a movable contact 31 is arranged at one end and a distal end face of the other end is cut and bent to the inner side to form a forced dissociation tongue piece 32. The movable contact piece 30 is rotatably supported by engaging a narrow width portion 33, which is formed by cutting out both side edges, to the rotation receiving portion 24 of the support terminal 21 (FIG. 3B).

The lock pin 35 is formed with lower ends 36, 37 by bending both ends of a rod-shaped metal material in opposite directions.

As shown in FIG. 2, the plunger 40 has a plane shape capable of being accommodated between the opposing insulation walls 12, 14 of the base 10, where an operation unit 41 is arranged in a projecting manner from the central part of the upper surface thereof. Furthermore, the plunger 40 is formed with a shaft portion 42 for supporting coil springs 50, 50, which are inserted from the side, so as to be symmetric with respect to a point at the front surface and the rear surface. The plunger 40 has a cam groove 43 formed in the up and down direction at the outer side surface. The cam groove 43 locks the plunger 40 at a predetermined position through the lock pin 35. Furthermore, as shown in FIG. 3A, the plunger 40 has a pushing projection 45 arranged in a projecting manner parallel to the shaft portion 42 at the lower surface. Both ends 51, 52 of the coil spring 50 are deflected towards the inner side to be inserted to the shaft portion 42 of the plunger 40, where one end 51 is pressure contacted to an edge 40*a* of the plunger 40 and the other end 52 is pressure contacted to the roof surface of the plunger 40. The one end 51 of the coil spring 50 is bent to a substantially right angle to form a forced dissociation bent portion 53.

As shown in FIG. 2, the housing 60 has a box-shape capable of being fitted to the outer peripheral portion of the base 10 assembled with the contact mechanism 20 and the plunger 40, and has an annular rib 62 of square plane arranged at the opening edge of an operation hole 61 formed at the middle of the upper surface thereof. Furthermore, the housing 60 has a pair of engagement holes 63 formed facing each other at the opening edge on the lower side. As shown in FIG. 1B, the housing 60 is arranged in a projecting manner with a positioning protrusion 64 that brings the lower end into contact with the movable contact piece 30 for position regulation, and a positioning protrusion 65 that engages the shaft portion 42 of the plunger 40 and pressure contacts the coil spring 50 from the side for positioning at the inner side surface.

An assembly method of the switch according to the first embodiment will be described below.

First, the plunger 40 having the coil spring 50 attached to the shaft portion 42 is assembled to the housing 60. The positioning protrusion 65 arranged on the inner side surface of the housing 60 is thereby fitted to a fit-in groove 46 of the plunger 40 and the coil spring 50 is pushed from the side for positioning. The housing 60 is assembled from above to the base 10 assembled with the contact mechanism 20. With this structure, the forced dissociation bent portion 53 arranged at one end 51 of the coil spring 50 slidably moves on the forced dissociation tongue piece 32 of the movable contact piece 30. Furthermore, when the plunger 40 is pushed down, the forced dissociation bent portion 53 of the coil spring 50 rides over and locks the distal end edge of the forced dissociation tongue piece 32 and biases the movable contact piece 30 so as to rise, and the movable contact 31 separates from the fixed contact 26. The assembly is completed when the engagement hole 63 of the housing 60 engages the engagement projection 17 of the base 10.

According to the present embodiment, the forced dissociation bent portion 53 of the coil spring 50 slidably moves on the forced dissociation tongue piece 32 of the movable contact piece 30, and the coil spring 50 and the movable contact piece 30 are automatically assembled, and thus skill is not required for assembling and the productivity is high.

The assembly method of the lock pin 35 will be described below.

Figure 5:
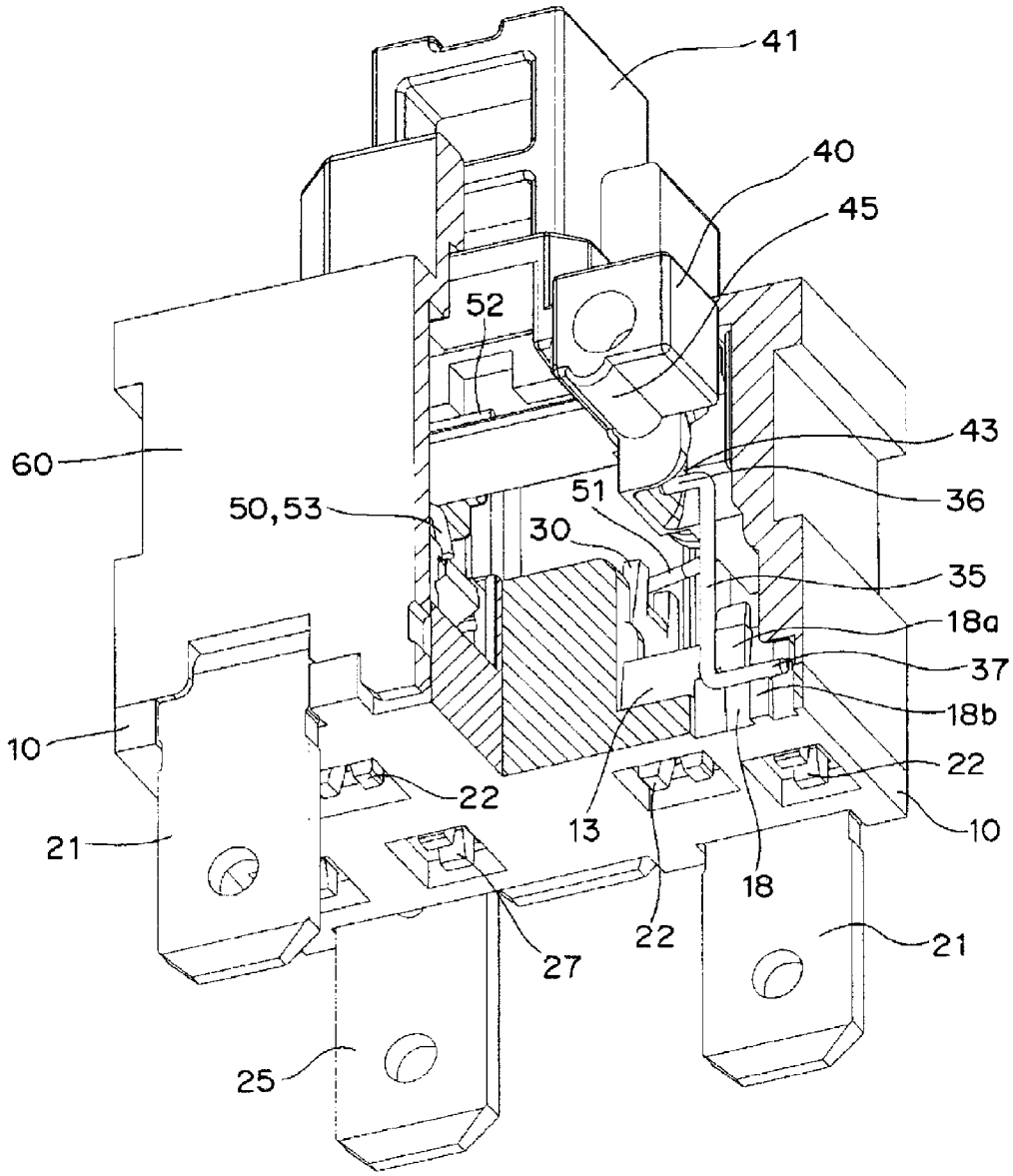
FIG. 5 is a partially cut perspective view of the switch shown in FIG. 1.

After tilting and inserting the lock pin 35 to the insertion hole 18 formed at the bottom surface of the base 10 shown in FIG. 5 while avoiding the engagement projection 18*a*, the lock pin 35 is perpendicularly raised and projected out from the engagement groove 13, and the lower end 37 is engaged with and prevented from slipping out from the elastic nail 18*b* to engage the upper end 36 to the cam groove 43 of the plunger 40.

According to the present embodiment, the lock pin 35 can be attached afterwards, and thereby assembly is facilitated and the productivity is enhanced.

The operation method of the switch according to the first embodiment will be described below.

Figures 6A, 6B, 6C, 6D, 6E:
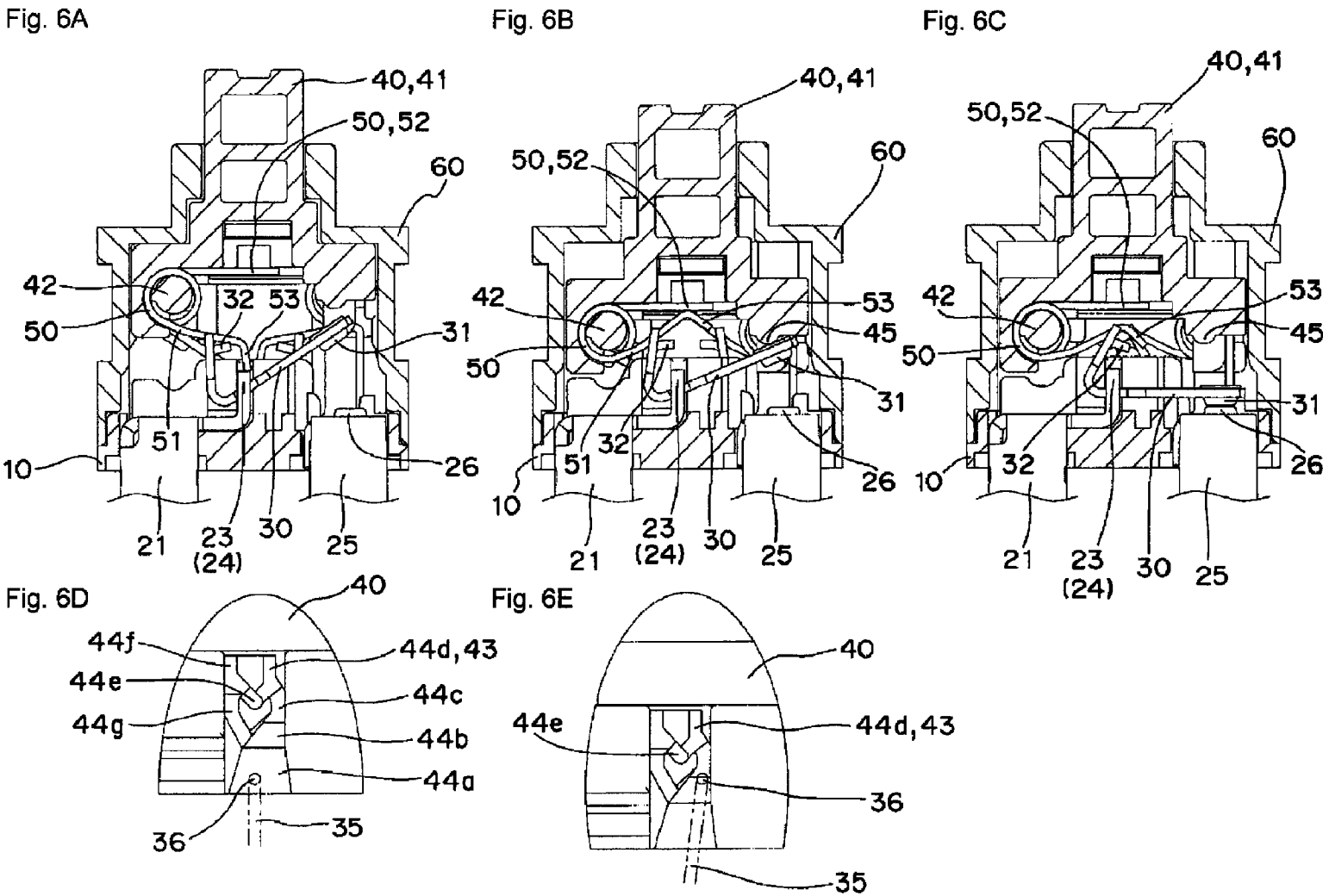
FIGS. 6A, 6B, and 6C are cross-sectional views showing an operation process.
FIGS. 6D and 6E are partially enlarged views showing an operation of a cam mechanism.

First, as shown in FIG. 6A, the plunger 40 is biased to the upper side with the spring force of the coil spring 50 before the operation. One end 51 of the coil spring 50 pushes down the forced dissociation tongue piece 32 of the movable contact piece 30. However, the movable contact piece 30 does not drop out since one end of the movable contact piece 30 comes into contact with the lower end of the position regulation protrusion 64 (FIG. 1B) arranged in a projecting manner on the inner side surface of the housing 60 and is position regulated. In this case, the upper end 36 of the lock pin 35 is positioned in an initial region 44*a* of the cam groove 43 of the plunger 40, as shown in FIG. 6D.

When the operation unit 41 of the plunger 40 is pushed down, the coil spring 50 deflects and the one end 51 biases the movable contact piece 30 in the rising direction while sliding on the forced dissociation tongue piece 32 of the movable contact piece 30 (FIG. 6C), and the pushing projection 45 pushes down one end of the movable contact piece 30. The upper end 36 of the lock pin 35 moves from the initial region 44*a* of the cam groove 43 to first and second inclined regions 44*b*, 44*c*. Furthermore, when the one end 51 of the coil spring 50 exceeds a predetermined position when the operation unit 41 of the plunger 40 is pushed in, the one end 51 of the coil spring 50 biases the movable contact piece 30 in a lowering direction through the forced dissociation tongue piece 32. Thus, the movable contact piece 30 instantaneously rotates with the rotation receiving portion 24 as the supporting point, and the movable contact 31 comes into contact with the fixed contact 26 (FIG. 6C).

Figure 7B:
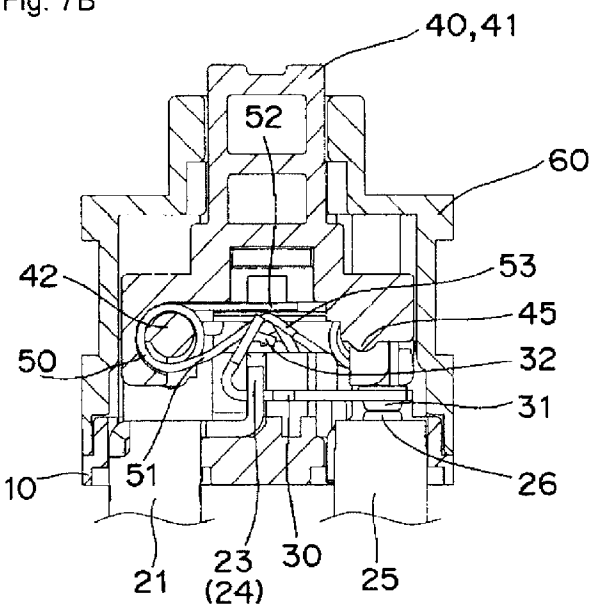
FIGS. 7A and 7B are cross-sectional views showing the operation process following
Figure 7D:
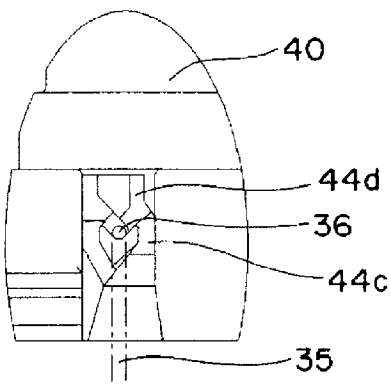
Figure 7A:
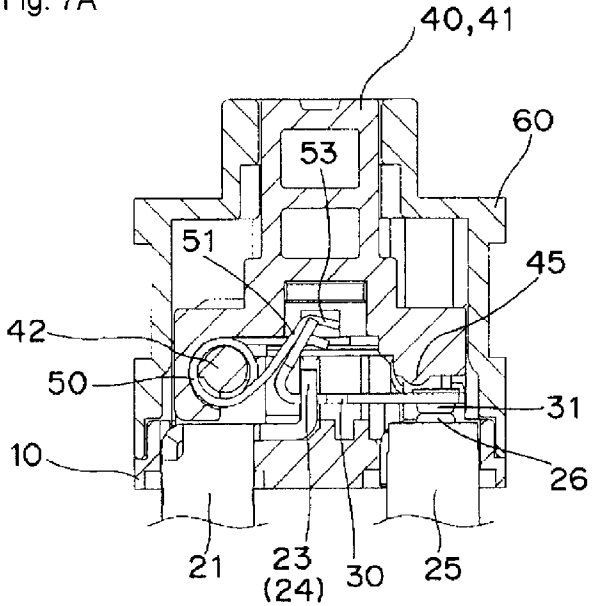
Figure 7C:
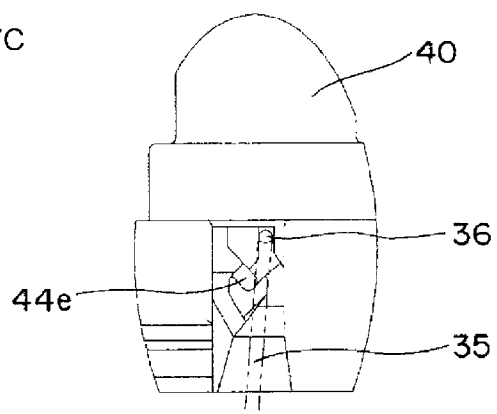

When the operation unit 41 of the plunger 40 is pushed to the lowest position (FIG. 7A), the upper end 36 of the lock pin 35 reaches a third inclined groove 44d (FIG. 7C). When the pushing of the plunger 40 is released, the plunger 40 is pushed up to the upper side with the spring force of the coil spring 50, but the upper end 36 of the lock pin 35 locks at a lock position 44e (FIG. 7D) and regulates the return of the plunger 40 to the upper side, whereby the locked state is achieved. Thus, the one end 51 of the coil spring 50 continues to bias the movable contact piece 30 in the lowering direction and the movable contact 31 continues to contact the fixed contact 26 (FIG. 7B).

Figure 8B:
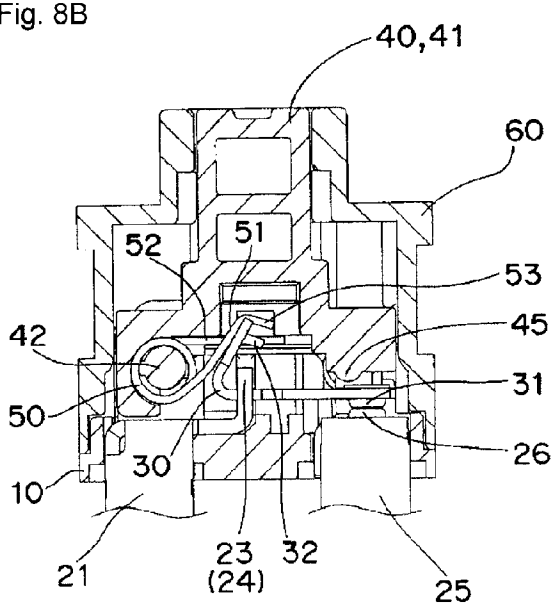
FIGS. 8A and 8B are cross-sectional views showing the operation process following
Figure 8D:
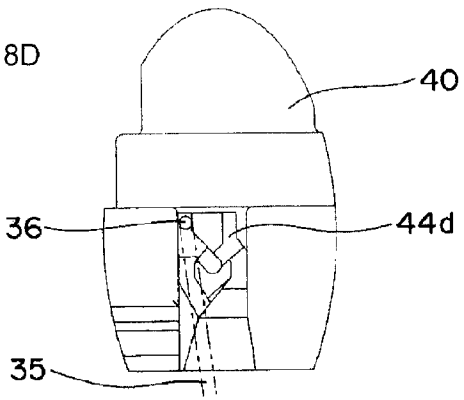
Figure 8A:
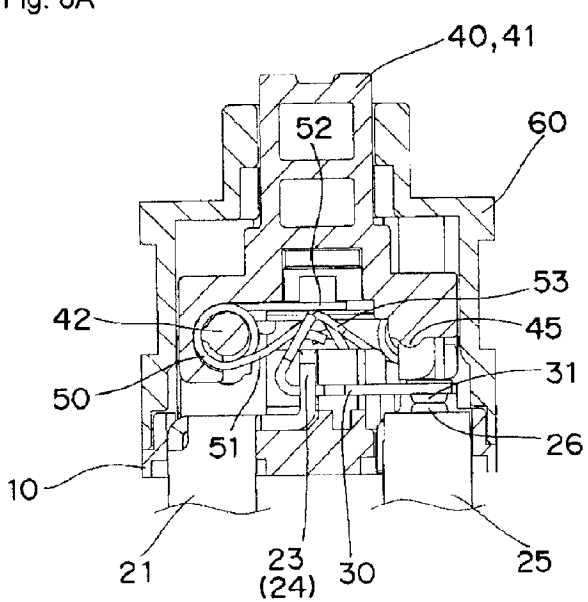
Figure 8C:
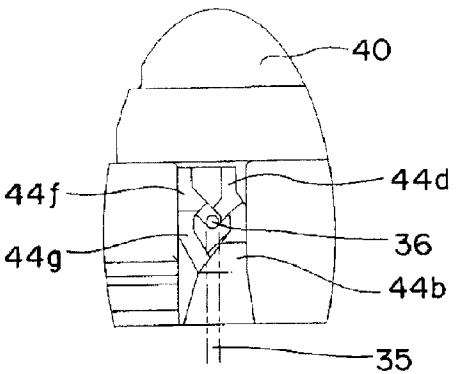
Figures 9A, 9B, 9C, 9D, 9E:
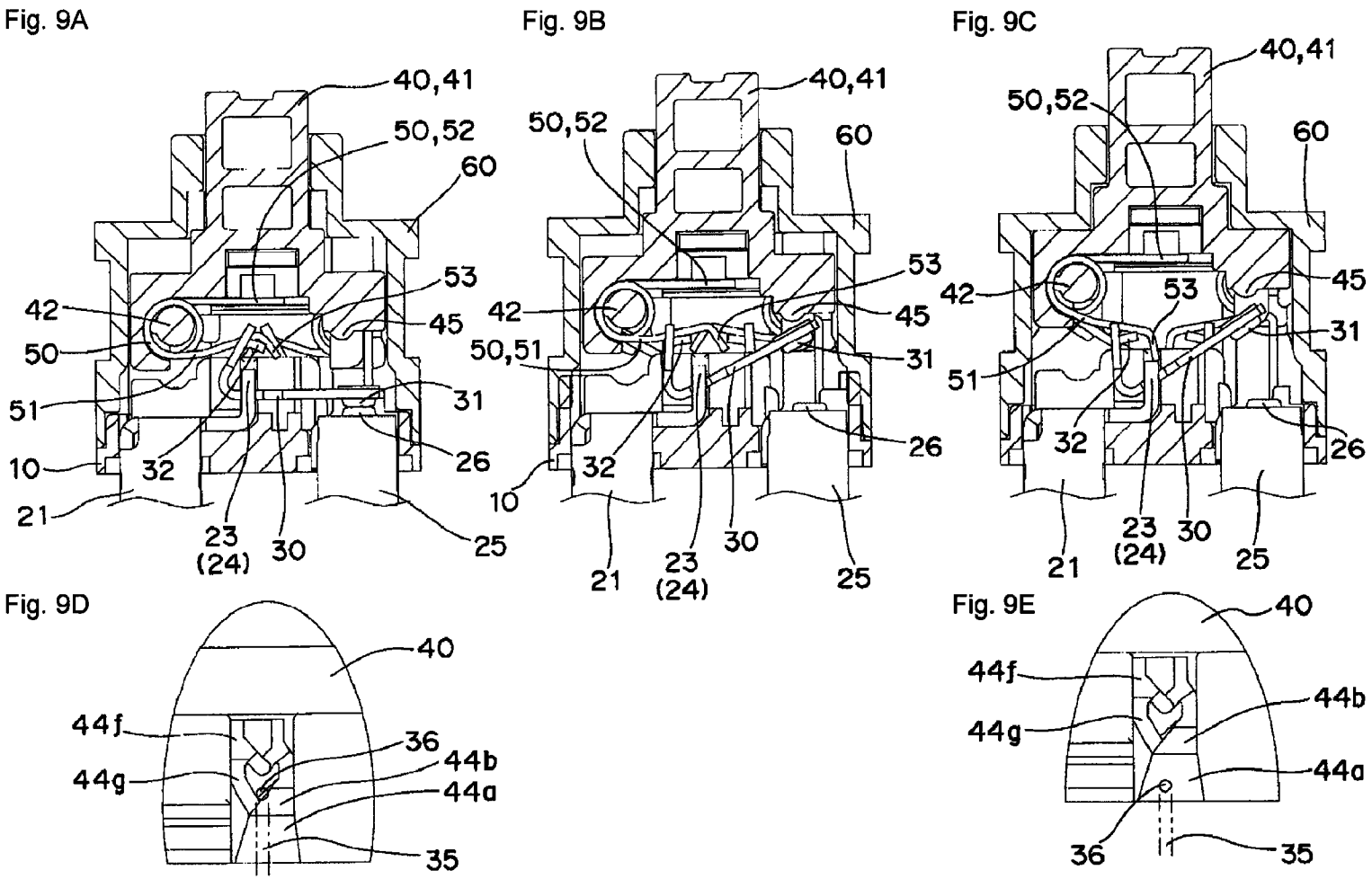

In unlocking the locked state (FIGS. 8A, 8C), the operation unit 41 of the plunger 40 is pushed down deeper (FIG. 8B), so that the upper end 36 of the lock pin 35 moves from the lock position to a fourth inclined groove 44f thereby unlocking the locked state (FIG. 8D). When the pushing of the operation unit 41 is released, the coil spring 50 pushes up the plunger 40 to the upper side while biasing the movable contact piece 30 in the lowering direction (FIG. 9A), and the upper end 36 of the lock pin 35 returns to the first inclined groove 44*b* through a fifth inclined groove 44*g* (FIG. 9D). Furthermore, when the plunger 40 is automatically returned to the original position, the one end 51 of the coil spring 50 biases the movable contact piece 30 in the rising direction from a predetermined position, the movable contact piece 30 instantaneously rotates with the rotation receiving portion 24 as the supporting point, and the movable contact 31 separates from the fixed contact 26 (FIG. 9B). Moreover, after the movable contact piece 30 rotates and the one end comes into contact with the pushing projection 45 of the plunger 40, the plunger 40 rises. Then, one end of the movable contact piece 30 comes into contact with the position regulation protrusion 64 arranged on the inner side surface of the housing 60 for position regulation. The upper end 36 of the lock pin 35 then returns to the initial region 44*a* (FIG. 9E).

Figure 10B:
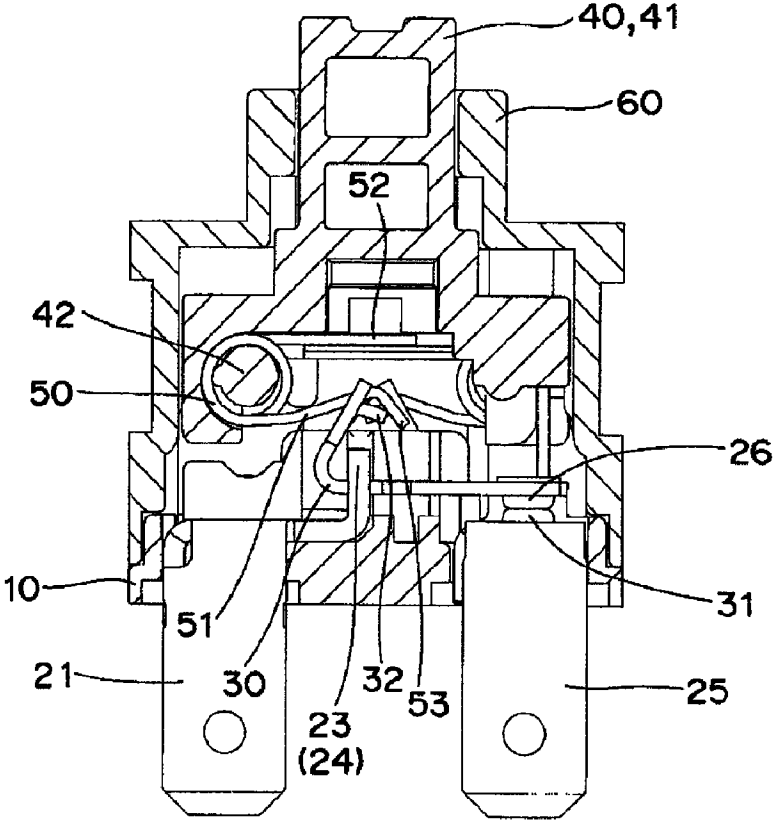
FIGS. 10A and 10B are cross-sectional views showing the operation process.
Figure 10A:
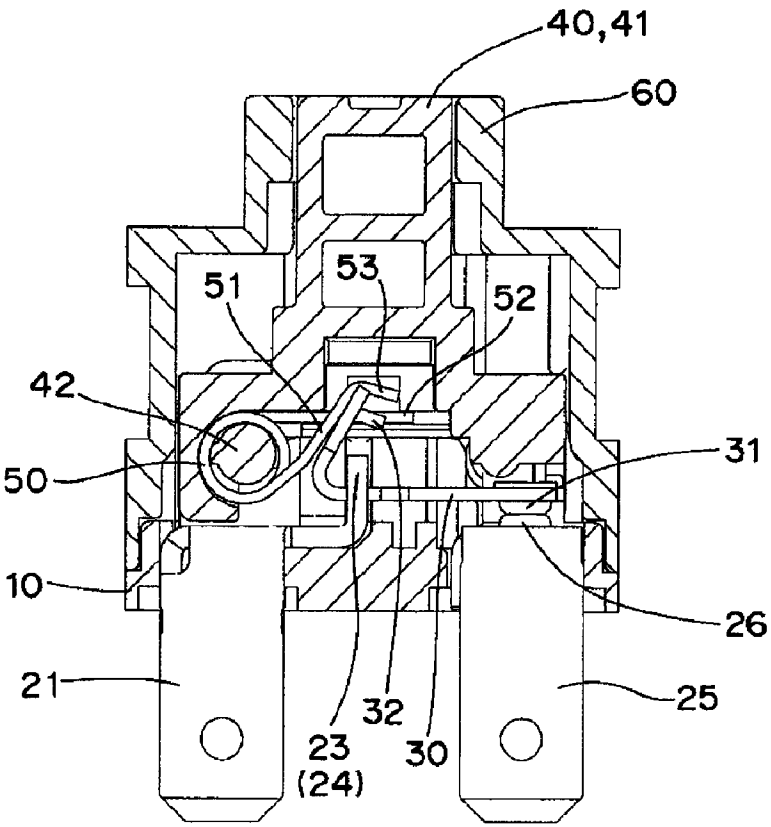
Figure 11B:
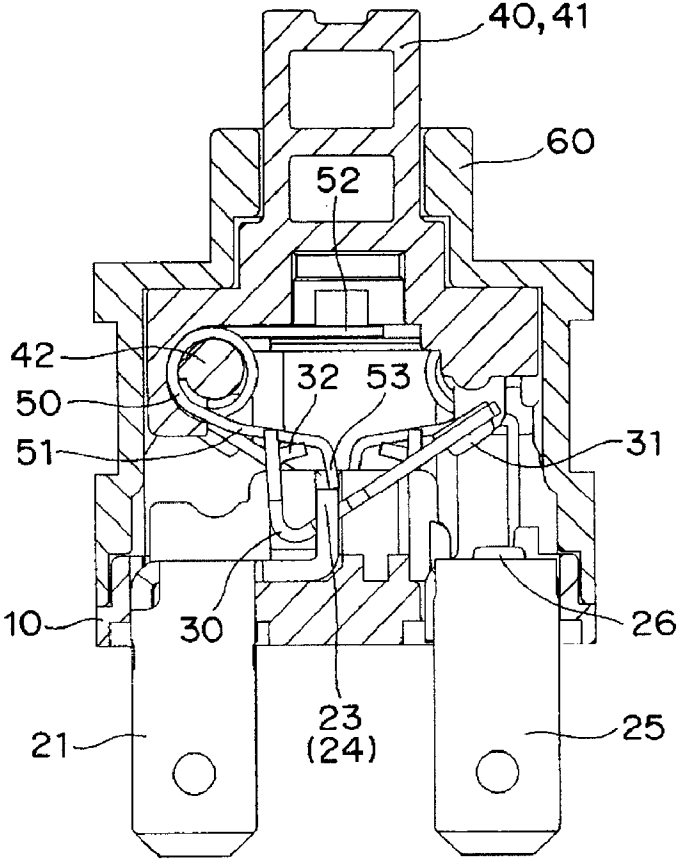
FIGS. 11A and 11B are cross-sectional views showing the operation process following FIGS. 10A and 10B.
Figure 11A:
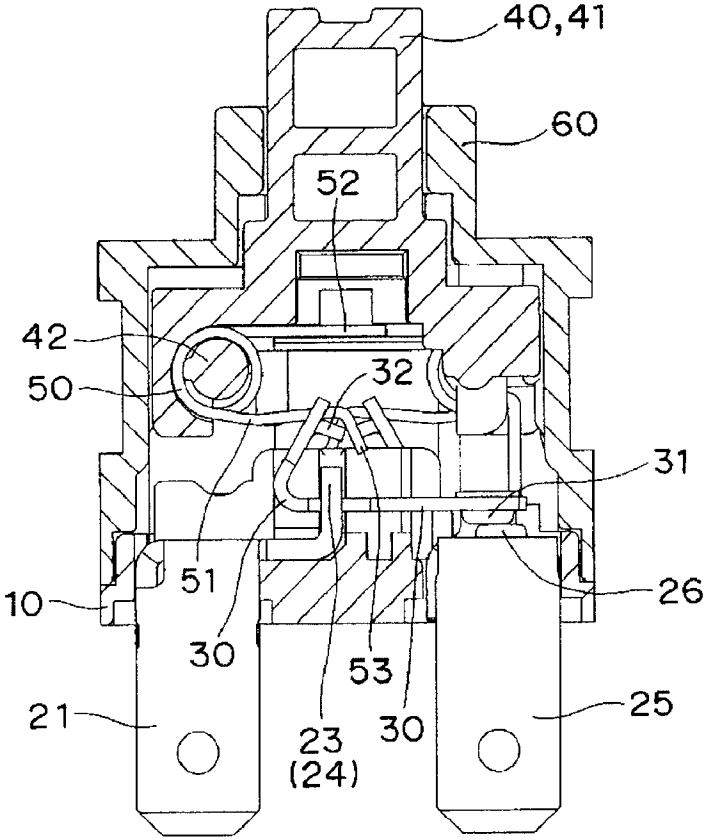
Figure 12A:
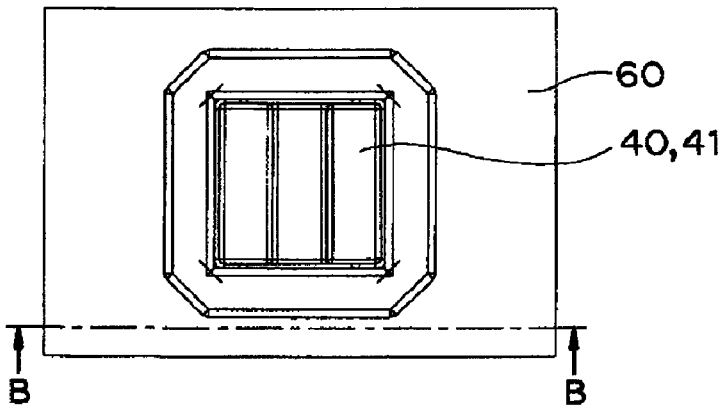
FIGS. 12A and 12B are a plan view and a cross-sectional view showing a switch according to a second embodiment of the present invention.
Figure 12B:
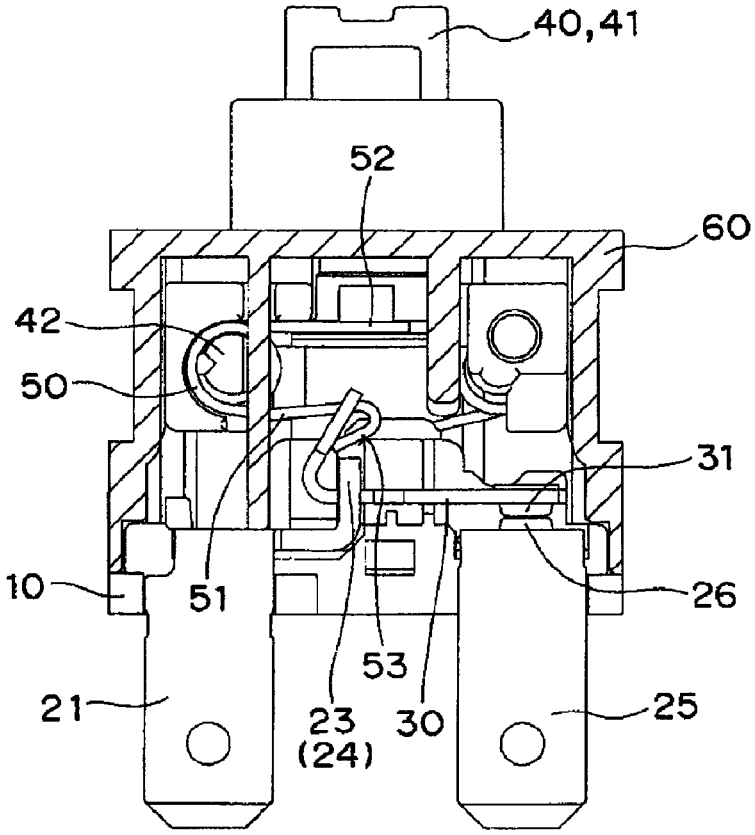
Figure 13A:
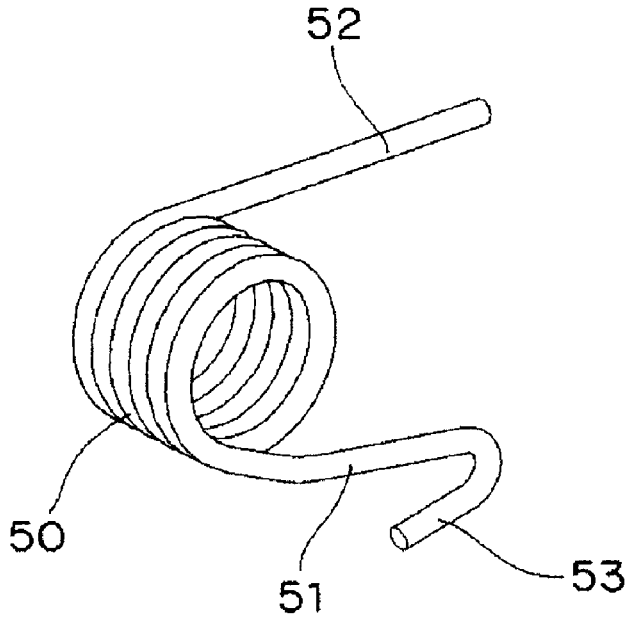
FIGS. 13A and 13B are perspective views showing a coil spring and a movable contact piece according to the second embodiment.
Figure 13B:
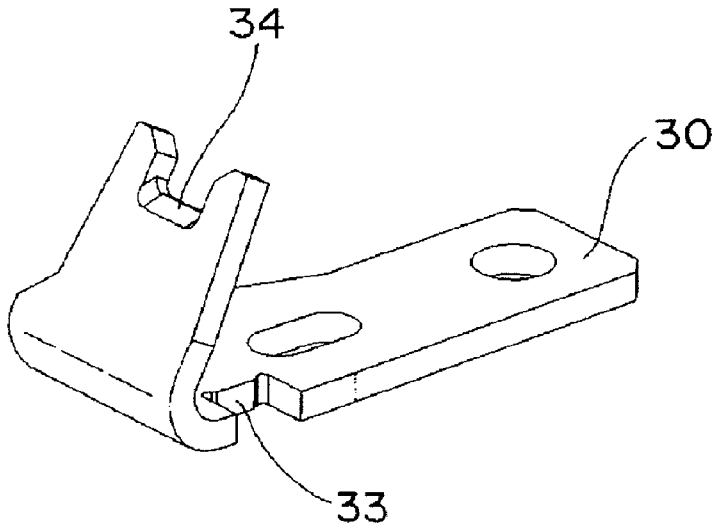
Figure 14A:
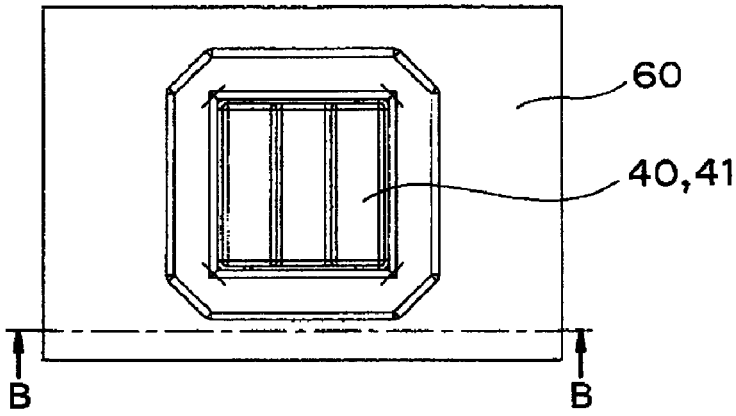
FIGS. 14A and 14B are a plan view and a cross-sectional view showing a switch according to a third embodiment of the present invention.
Figure 14B:
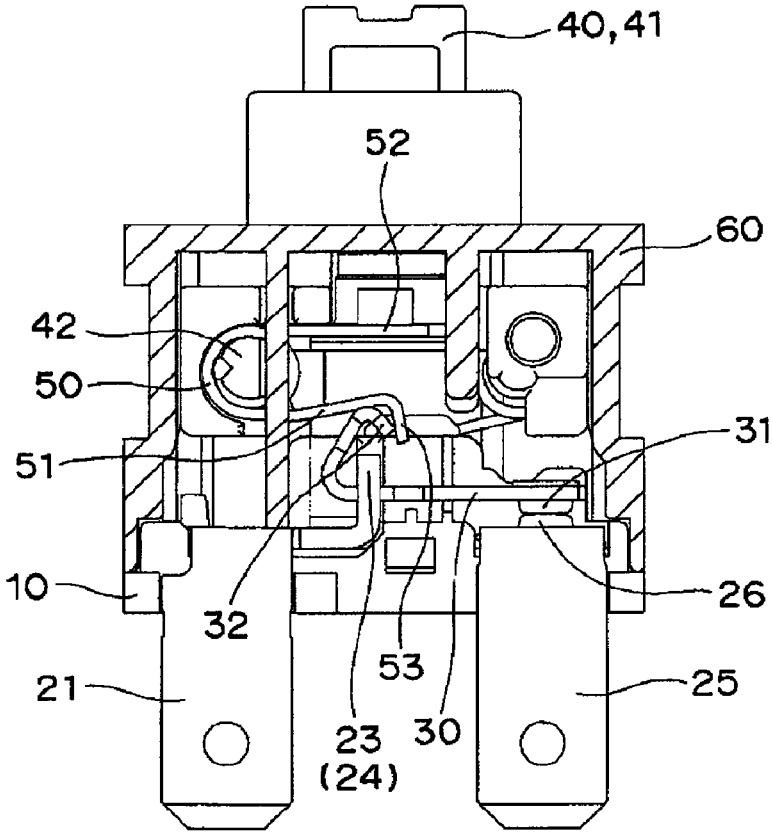
Figure 15A:
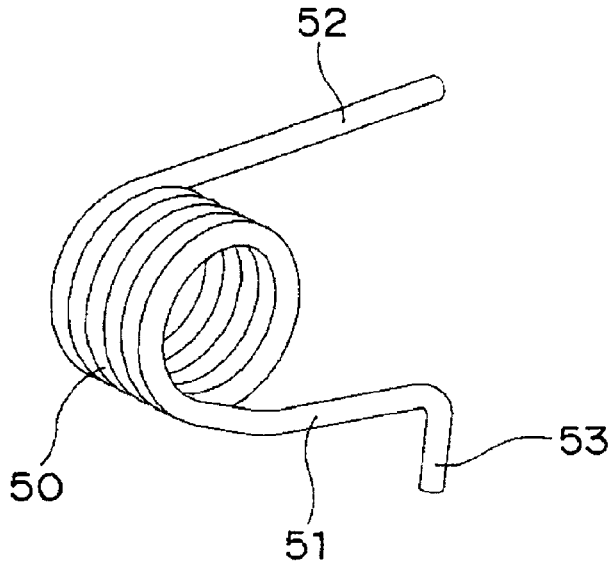
FIGS. 15A and 15B are perspective views showing a coil spring and a movable contact piece according to the third embodiment.
Figure 15B:
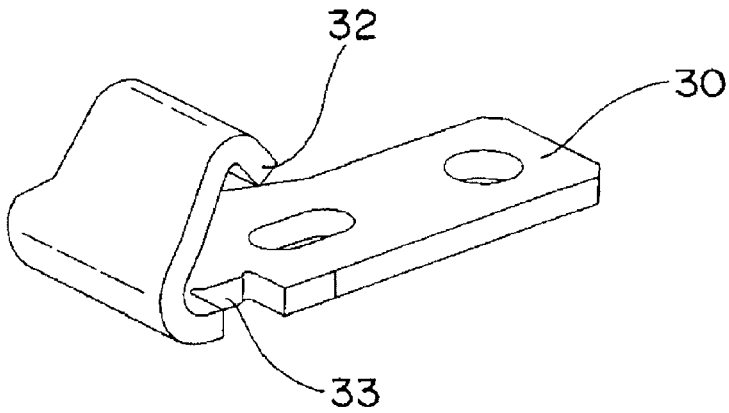
Figure 16A:
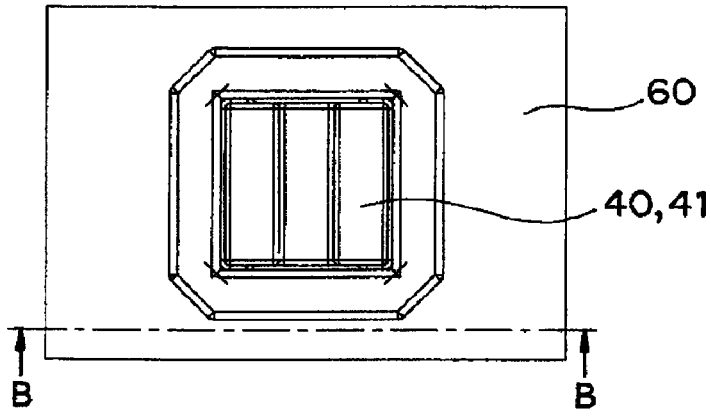
FIGS. 16A and 16B are a plan view and a cross-sectional view showing a switch according to a fourth embodiment of the present invention.
Figure 16B:
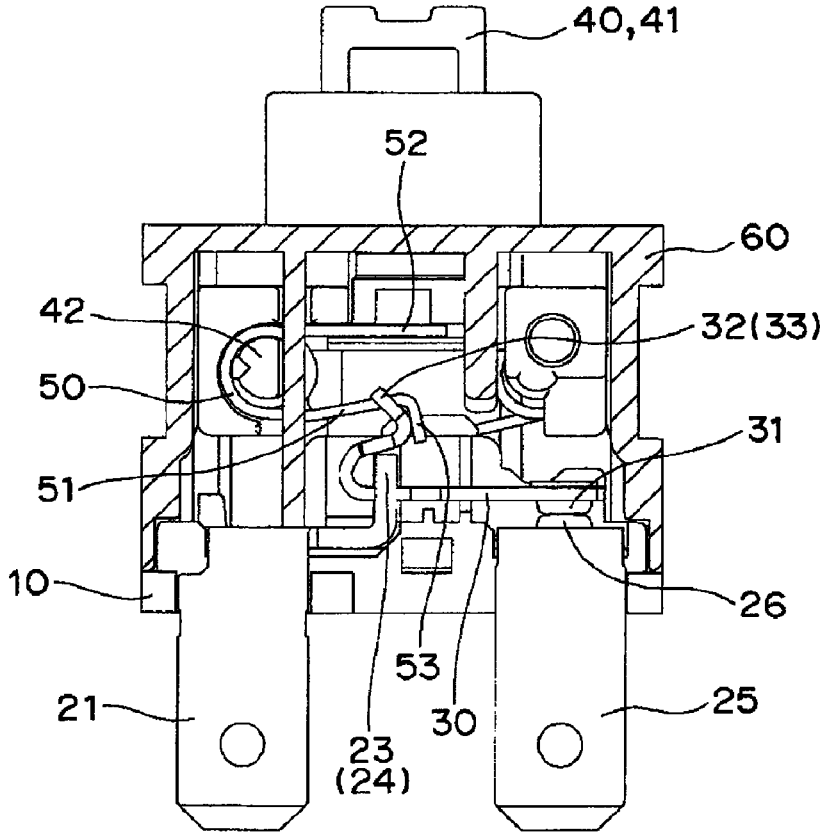
Figure 17A:
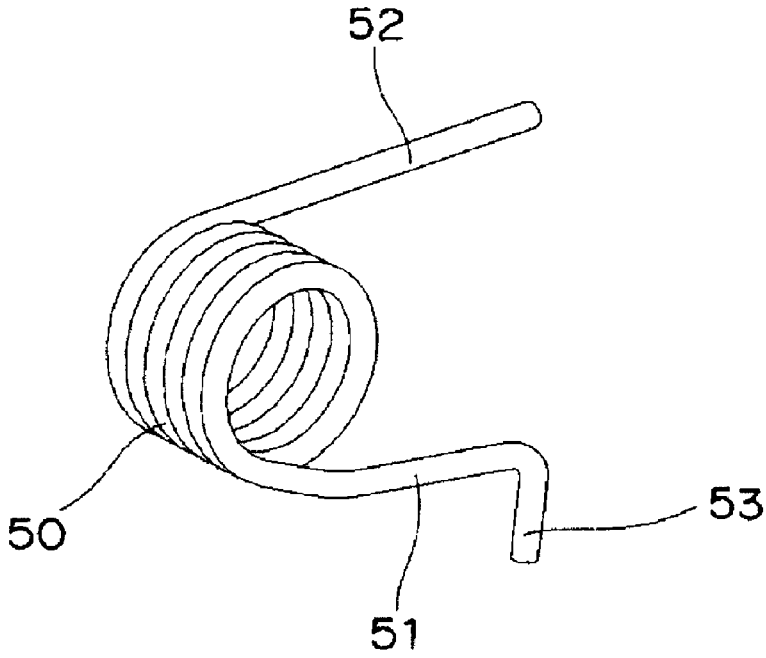
FIGS. 17A and 17B are perspective views showing a coil spring and a movable contact piece according to a fifth embodiment of the present invention.
Figure 17B:
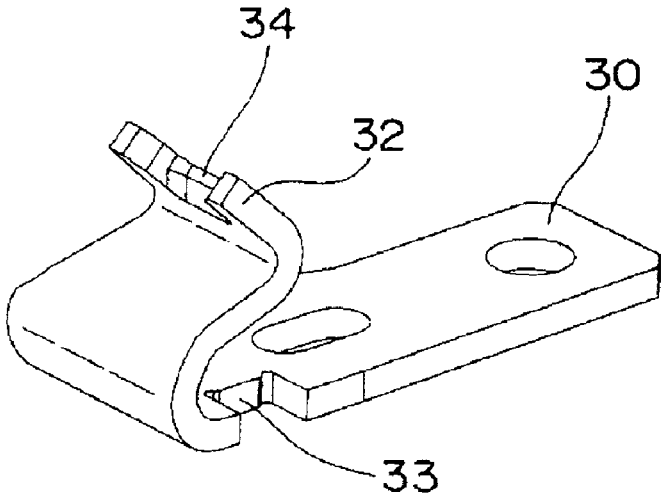
Figure 18A:
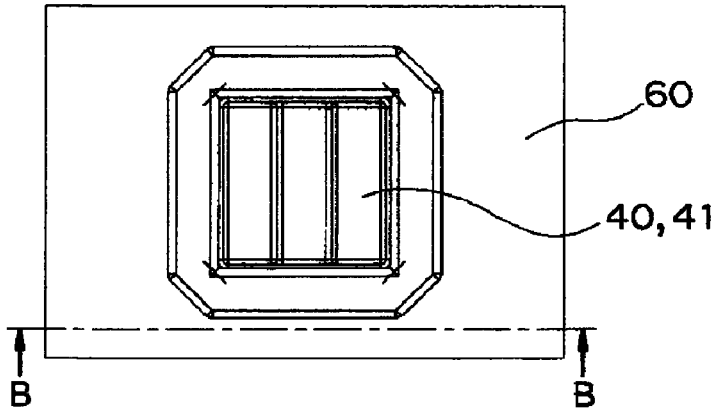
FIGS. 18A and 18B are a plan view and a cross-sectional view showing a switch according to a sixth embodiment of the present invention.
Figure 18B:
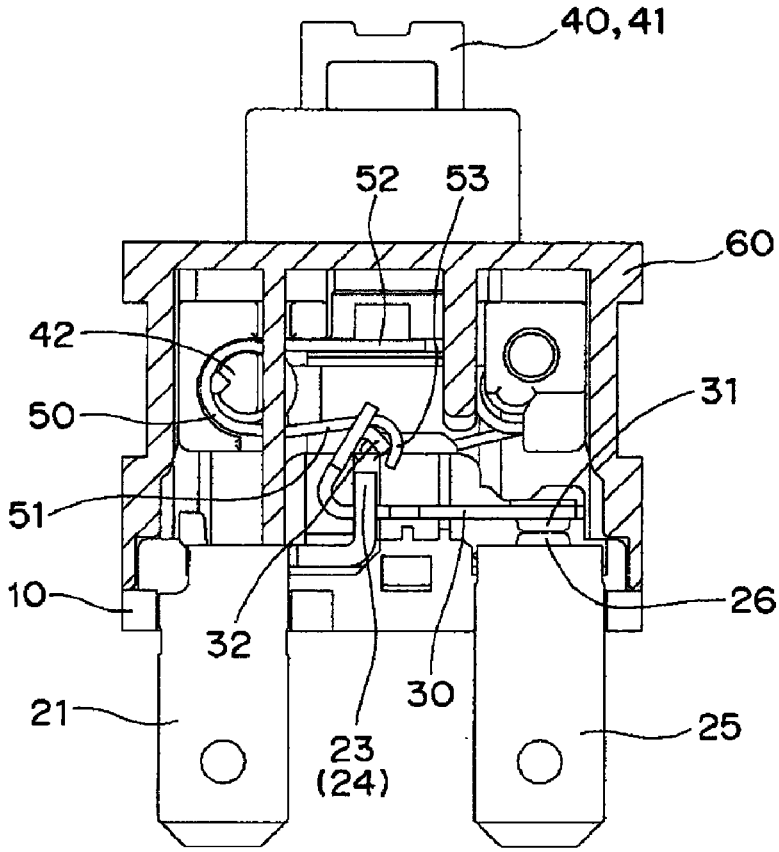
Figure 19A:
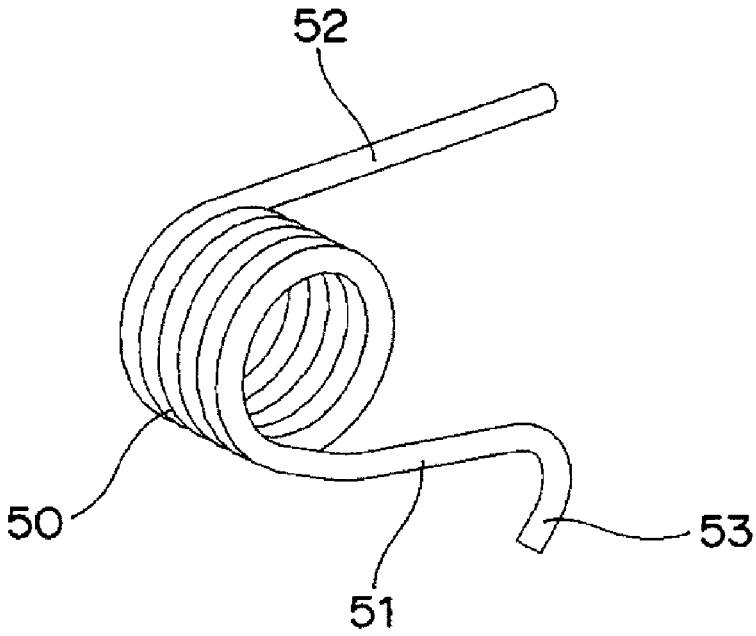
FIGS. 19A and 19B are perspective views showing a coil spring and a movable contact piece according to the sixth embodiment.
Figure 19B:
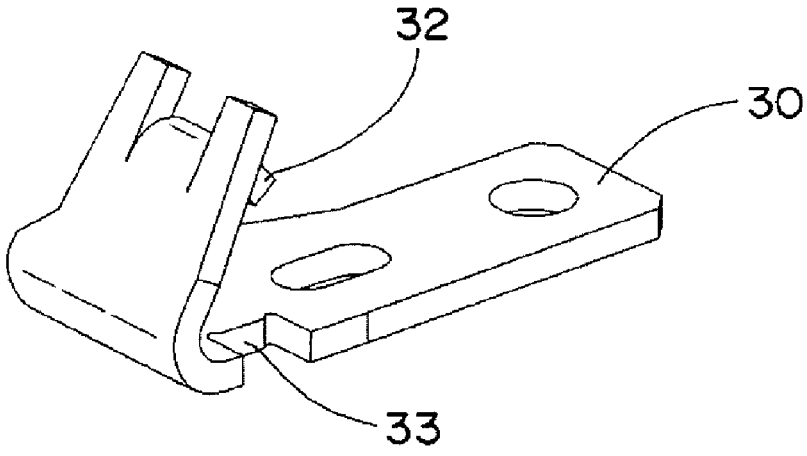

As shown in FIGS. 10A, 10B, 11A, and 11B, if the movable contact 31 is welded to the fixed contact 26, when the pushing with respect to the operation unit 41 of the plunger 40 is released, the other end 52 of the coil spring 50 pushes up the operation unit 41 and the forced dissociation bent portion 53 arranged at the one end 51 locks with the edge of the forced dissociation tongue piece 32 of the movable contact piece 30 and biases the same to rise (FIG. 10B). Thus, even if the fixed contact 26 and the movable contact 31 are welded, the horizontal component force based on the spring force of the coil spring 50 acts as a shear force thereby breaking the contact welding (FIG. 11A). As a result, the movable contact 31 separates from the fixed contact 26, the movable contact piece 30 is raised by the spring force of the one end 51 of the coil spring 50, and the movable contact 31 separates from the fixed contact 26 (FIG. 11B) thereby preventing malfunction.

The switch according to the first embodiment may be used simply as a push switch without attaching the lock pin 35 afterwards.

As shown in FIGS. 12A, 12B, 13A, and 13B, a second embodiment is substantially similar to the first embodiment, and differs in that a cutout portion 34 is formed at the distal end face of the other end of the movable contact point 30 and the one end 51 of the coil spring 50 is bent to a substantially U-shape to form the forced dissociation bent portion 53. Others are substantially the same as the first embodiment, and thus same reference numbers are denoted for the same portions, and the description thereof will not be given.

According to the present embodiment, a large shear force can be exerted on the movable contact piece 30 at an early stage and the bending moment acts on the movable contact piece 30 by locking the distal end of the bent portion 53 to the inner side surface edge of the cutout portion 34 of the movable contact piece 30, and thus the contact welding can be effectively resolved.

Furthermore, the forced dissociation tongue piece does not need to be cut and bent at one end of the movable contact piece 30, the number of production steps of the movable contact piece 30 is reduced, and the productivity is enhanced.

As shown in FIGS. 14A, 14B, 15A, and 15B, a third embodiment is substantially the same as the first embodiment, and differs in that the entire other end edge of the movable contact piece 30 is bent to the inner side to form the forced dissociation tongue piece 32 and the one end 51 of the coil spring 50 is bent to substantially right angle to form the forced dissociation bent portion 53.

According to the present embodiment, the contact welding can be effectively resolved since the distal end edge of the forced dissociation tongue piece 32 of the movable contact piece 30 is locked with the forced dissociation bent portion 53 of the coil spring 50, a large shear force is exerted on the movable contact piece 30 at an early stage, and the bent moment acts on the movable contact piece 30.

Since the forced dissociation bent portion 53 of the coil spring 50 locks with the forced dissociation tongue piece 32 of wide width of the movable contact piece 30, it is less likely to drop out and high reliability can be obtained.

As shown in FIGS. 16A, 16B, 17A, and 17B, a fourth embodiment is substantially the same as the first embodiment, and differs in that the other end edge of the movable contact piece 30 is bent to the outer side to form the forced dissociation tongue piece 32, and the central part of the distal end face is cutout to form the cutout portion 34. The difference also lies in that the one end 51 of the coil spring 50 is bent to a substantially right angle to form the forced dissociation bent portion 53.

According to the present embodiment, the one end 51 of the coil spring 50 engages the cutout portion 34 of the movable contact piece 30 and the distal end of the bent portion 53 locks with the forced dissociation tongue piece 32. Thus, in addition to the one end 51 of the coil spring 50 being less likely to drop out from the movable contact piece 30, a large shear force can be exerted on the movable contact piece 30 at an early stage and the bending moment for raising the movable contact piece can be acted thereon. As a result, the contact welding can be effectively resolved.

As shown in FIGS. 18A, 18B, 19A, and 19B, a fifth embodiment is substantially the same as the first embodiment, and differs in that the central part at the distal end face at the other end of the movable contact piece 30 is cut and bent to form the forced dissociation tongue piece 32, and the one end 51 of the coil spring 50 is bent to a substantially C-shape to form the forced dissociation bent portion 53.

According to the present embodiment, the bent portion 53 is less likely to drop out as the bent portion 53 of the coil spring 50 locks with the distal end edge of the forced dissociation tongue piece 32 of the movable contact piece 30. In particular, the spring force of the coil spring 50 acts on the distal end edge of the bent portion 53 as a large shear force at an early stage, and the bending moment acts to raise the movable contact piece 30, and thus the contact welding can be effectively resolved.

EXAMPLE

In the switch according to the first embodiment of the present invention, the operation position where the spring force of the coil spring 50 acts and the shear force are measured. The measurement result is shown in FIG. 20.

Figure 20:
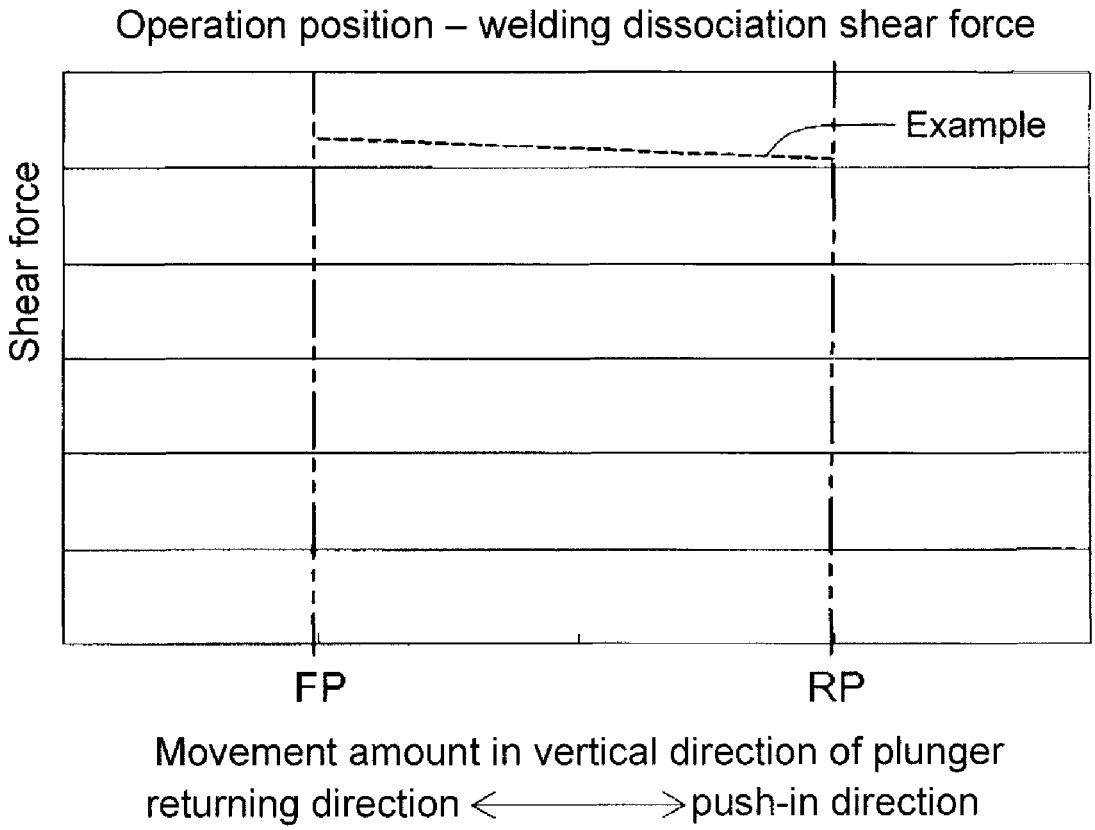
FIG. 20 is a graph showing operation characteristics of an example of the switch according to one or more embodiments of the present invention and a switch according to a conventional example.

As apparent from FIG. 20, the shear force starts to act on the movable contact from the release position (RP) or a position where conduction state of the contact is eliminated when normally operated, and the shear force acts on the movable contact up to the free position (FP) or the position where the plunger 40 is completely returned. In particular, the contact welding can be effectively resolved as the large shear force acts from the release position to the free position.

One or more embodiments of switch according to the present invention has two sets of contact mechanisms arranged on the base such as in the above-described switch, but is not limited thereto, and one set of contact mechanism may be arranged.

The pushing projection 45 of the plunger 40 may be arranged in any one of the embodiments described above, as necessary, or may not be arranged, if unnecessary.

What is claimed is:

1. A switch comprising:

a supporting terminal assembled to a base;

a movable contact piece, made of a conductive material bent to a substantially J-shaped cross section, having a movable contact at one end and having an intermediate portion rotatably supported by a rotation receiving portion of the supporting terminal;

a plunger accommodated so as to be movable up and down in an internal space formed by fitting a housing to the base; and a coil spring including a forced dissociation bent portion at one end and being rotatably supported by the plunger;

wherein the plunger is moved up and down to slidably move one end of the coil spring while pressure contacting the other end edge of the movable contact piece to invert the movable contact piece and contact or separate the movable contact to and from a fixed contact, and to lock a distal end of the forced dissociation bent portion to the other end edge of the movable contact piece and exert a shear force on the movable contact of the movable contact piece.

2. The switch according to claim 1, wherein a middle of the other end edge of the movable contact piece is cut and bent to an inner side to form a forced dissociation tongue piece that locks with the forced dissociation bent portion of the coil spring.

3. The switch according to claim 1, wherein a cutout portion is formed at the other end edge of the movable contact piece, and the one end of the coil spring is bent to a substantially U-shape to form the forced dissociation bent portion which distal end locks with an inner side surface edge of the cutout portion.

4. The switch according to claim 1, wherein the forced dissociation bent portion of the coil spring is locked with a forced dissociation tongue piece formed by bending the entire other end edge of the movable contact piece to an inner side surface side.

5. The switch according to claim 1, wherein the entire other end edge of the movable contact piece is bent to an outer side surface side to form a forced dissociation tongue piece, a cutout portion is formed at a central part thereof, the one end of the coil spring is engaged to the cutout portion, and the forced dissociation bent portion is locked with the forced dissociation tongue piece.

6. The switch according to claim 1, wherein a middle of the other end edge of the movable contact piece is cut and bent to an inner side to form a forced dissociation tongue piece, the one end of the coil spring is bent to a substantially C-shape to form the forced dissociation bent portion, and the forced dissociation bent portion is locked with the forced dissociation tongue piece.

* * * * *